US006964147B2

(12) United States Patent
Gambetti

(10) Patent No.: US 6,964,147 B2
(45) Date of Patent: Nov. 15, 2005

(54) OPERATING METHOD FOR A PACKAGING MACHINE OF THE "SLEEVE" TYPE, PACKAGING MACHINE FOR IMPLEMENTING THE SAID METHOD, AND PACKAGE PRODUCED BY THE SAID METHOD

(75) Inventor: Mario Gambetti, Castelfranceo Emilia (IT)

(73) Assignee: Balmer S.R.L., Castelfranco Emilia (IL)

( * ) Notice: Subject to any disclaimer, the term of this patent is extended or adjusted under 35 U.S.C. 154(b) by 0 days.

(21) Appl. No.: 10/661,354

(22) Filed: Sep. 12, 2003

(65) Prior Publication Data

US 2005/0072123 A1 Apr. 7, 2005

(30) Foreign Application Priority Data

Sep. 30, 2002 (IT) ..... BO2002A0614

(51) Int. Cl.[7] ..... B65B 41/00
(52) U.S. Cl. ..... 53/465; 53/389.5
(58) Field of Search ..... 53/389.5, 389.4, 53/389.3, 589, 588, 210, 465, 557

(56) References Cited

U.S. PATENT DOCUMENTS

| | | | | |
|---|---|---|---|---|
| 4,706,444 A | | 11/1987 | Gambetti | |
| 5,203,144 A | | 4/1993 | Gambetti | |
| 5,442,899 A | * | 8/1995 | Shibazaki et al. | 53/589 |
| 5,873,213 A | * | 2/1999 | Draghetti | 53/389.2 |
| 6,250,051 B1 | * | 6/2001 | Mori et al. | 53/453 |
| 6,381,919 B2 | * | 5/2002 | Todd et al. | 53/64 |
| 6,474,041 B1 | * | 11/2002 | Gambetti | 53/141 |
| 6,722,103 B2 | * | 4/2004 | Gambetti | 53/411 |

FOREIGN PATENT DOCUMENTS

| | | |
|---|---|---|
| DE | 40 35 350 | 5/1991 |
| EP | 0 629 551 | 12/1994 |
| EP | 0 949 145 | 10/1999 |
| FR | 2 669 604 | 5/1992 |
| GB | 2 237 785 | 5/1991 |

* cited by examiner

*Primary Examiner*—John Paradiso
(74) *Attorney, Agent, or Firm*—Herbert Dubno

(57) ABSTRACT

A method of operating a packaging machine and a packaging machine operated by the method, whereby sheets of a packaging material are given an undulating configuration with one or more crests before an end of the sheet is passed between object conveyors and then carried by a wrapping bar around the object to be wrapped.

24 Claims, 4 Drawing Sheets

OPERATING METHOD FOR A PACKAGING MACHINE OF THE "SLEEVE" TYPE, PACKAGING MACHINE FOR IMPLEMENTING THE SAID METHOD, AND PACKAGE PRODUCED BY THE SAID METHOD

FIELD OF THE INVENTION

The present invention relates to an operating method for a packaging machine of the "sleeve" type, a packaging machine for implementing the said method, and a package produced by the said method.

BACKGROUND OF THE INVENTION

At the present time—see for example U.S. Pat. No. 5,203,144—sheets of sheet material are fed to the wrapping means by a feed system comprising three operating members and various devices and, more particularly, from the upstream to the downstream end, sheet feed means, a first sheet conveyor and a second sheet conveyor, in which the said sheet feed means feed the sheets towards and on to the first sheet conveyor, in which the said two sheet conveyors are placed in sequence with respect to the direction of feed of the sheets, in which by means of the said various devices the first sheet conveyor, located upstream, is driven at a constant speed and the second sheet conveyor, located downstream, is driven at variable speed.

This known system carries out the function of feeding the sheets to the wrapper means very successfully, but gives rise to various problems.

A first problem is due to the fact that the system comprises a multiplicity of components, with consequent high production, maintenance and running costs.

A second problem is due to the fact that two phases of transfer are provided for each sheet, namely a first phase in which the sheet is transferred from the feed means to the first sheet conveyor and a second phase in which the sheet is transferred from the said first sheet conveyor to the said second sheet conveyor with consequent possible errors of misalignment of the longitudinal position of the sheet during the said transfers, in which the summation of two possible transfer errors could bring about an incorrect positioning of the sheet (in other words leading or lagging) with respect to the machine cycle of the advance of the objects and/or of the wrapping bars.

OBJECT OF THE INVENTION

The object of the present invention is therefore to resolve the aforesaid problems.

SUMMARY OF THE INVENTION

The invention, which is characterized by the claims, resolves the problem of creating an operating method for a packaging machine of the "sleeve" type, which wraps sheets of packaging material around objects, in which the said machine comprises first object conveyor means, for feeding the objects longitudinally in sequence with spaces between them; second object conveyor means, located downstream and at a small distance from the said first object conveyor means, forming a first opening between the said first and the said second object conveyor means for receiving the objects arriving from the said first object conveyor means and for moving the said objects along a wrapping plane which has an entry end and an exit end; third object conveyor means, located downstream and at a small distance from the said second object conveyor means, forming a second opening between the said second and the said third object conveyor means, for receiving the objects arriving from the said second object conveyor means; sheet wrapping means, located in the proximity of the said second object conveyor means, comprising at least one suspended wrapping bar which is orientated transversely with respect to the direction of advance of the objects, and is caused to move through the said first and the said second aperture along an orbital path which circumscribes the top of the said second object conveyor means, and capable of transporting the sheets of packaging material; sheet conveyor means of the conveyor belt type, located underneath and aligned with the said first opening and in proximity thereto, for feeding the sheets of packaging material in the proximity of the said first opening; and synchronizing means for synchronizing the said operating means with each other, in which the said method is characterized in that the sheets of packaging material are fed along the said sheet conveyor of the conveyor belt type in a configuration having a accumulated portion of material and in that the said wrapping bar collects the said accumulated portion of material in the proximity of the said first opening and then carries out the phase of transport of the sheet.

The invention, which is characterized by the claims, also resolves the problem of creating a packaging machine of the "sleeve" type for implementing the aforesaid method, and also a package produced by the said method.

The use of a method and machine of this type yields the following results: the packaging operations are simplified, the operations of transferring the sheets are reduced, the two sheet conveyors arranged in series one after the other for feeding the sheets to the wrapping means are not required, and the devices for driving the said two sheet conveyors are not required.

The advantages obtained by means of the present invention consist, principally, in an improvement of the packaging operations and in a reduction of the production, maintenance and running costs of the corresponding machine.

BRIEF DESCRIPTION OF THE DRAWING

Further characteristics and advantages of the present invention will be made clearer by the following description of a preferred example of embodiment thereof, given here purely by way of example and without restrictive intent, with reference to the attached drawing, in which.

SPECIFIC DESCRIPTION

Figure 1:
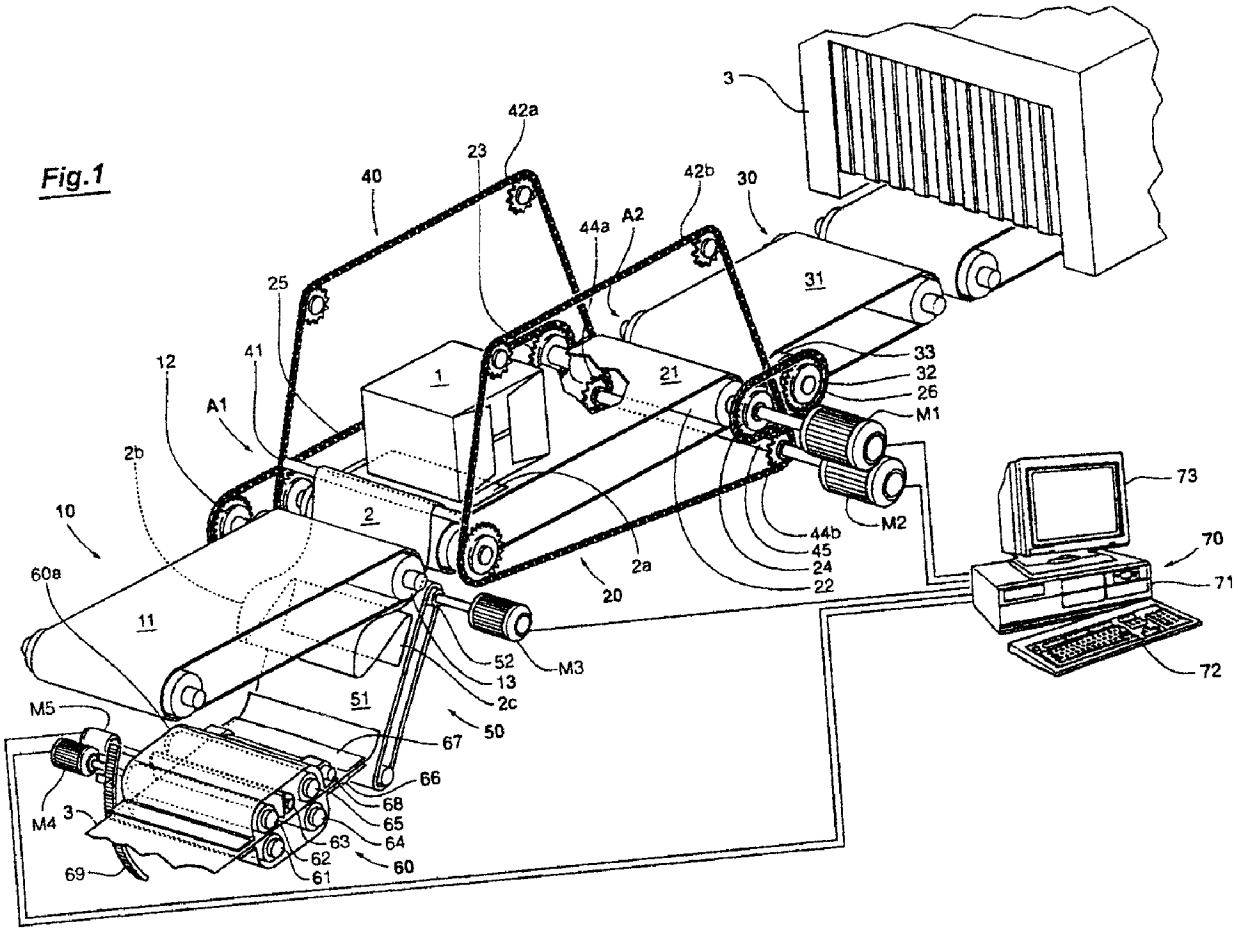
FIG. 1 is a schematic illustration of the system according to the present invention, incorporated in a packaging machine.

FIG. 1 shows an automatic packaging machine of the "sleeve" type, for wrapping individually and in succession the objects 1 by means of sheets 2 of wrapping material. The objects 1 can be single units or groups of bottles or other kinds of object. The sheets 2 can be sheets of heat-shrinking polyethylene or the like, in which, essentially, the sheets 2 are wrapped in the form of sleeves around the objects 1.

After wrapping the object and sheet assembly 1-2 produced in this way is heat-shrunk, if required, in a heat-shrinking oven 3.

The said system essentially comprises first object conveyor means 10, second object conveyor means 20, third object conveyor means 30, sheet wrapping means 40, sheet conveyor means 50, sheet feed means 60 and synchronizing means 70.

With reference to FIG. 1, the said three object conveyor means 10, 20, 30 comprise three conveyors of the conveyor belt type, the belts being indicated by 11, 21 and 31 30 respectively. which are arranged in series one after the other and spaced apart by small gaps longitudinally, in order to form a first opening, A1, between conveyors 10 and 20, and a second opening, A2, between conveyors 20 and 30.

A servo motor MI, preferably of the speed and phase control type, such as a brushless motor with a servo control system, drives the three conveyors 10, 20 and 30, by directly driving a roller shaft 22 of the second object conveyor 20, at the opposite ends of which there are keyed gears 23 and 24, on which run the chains 25 and 26 respectively, in which the first chain 25 also runs around a gear 12 keyed on a roller shaft 13 which drives the first object conveyor 10 and the second chain 26 also runs around a gear 32 keyed on a roller shaft 33 which drives the third object conveyor 10 30.

The motor M1, for reasons which will be made clear subsequently, is connected to and controlled by the synchronizing means 70, which can comprise a programmable control unit 71 such as a PLC and/or a computer and/or other device, programmable by means of a keyboard 72 and provided with a corresponding display unit 73.

The second object conveyor 20 interacts with the sheet wrapper means 40, comprising at least one transverse wrapping bar 41 which orbits around the said second object conveyor 20, passing through the said first opening A1 and the said second opening A2, in which the said bar 41 has its opposite ends supported by two corresponding chains 42*a* and 42*b*, which run around corresponding gears.

The chains 42*a* and 42*b* are driven by a first pair of sprockets 44*a* and 44*b*, keyed on the ends of a single shaft 45, which in turn is driven by a servo motor M2, preferably of the speed and phase control type, such as a brushless motor with a servo control system, which is also connected to the synchronizing means 70.

In the area underneath the object conveyor 20, in the proximity of its entry end, there are positioned the sheet conveyor means 50, which comprise a conveyor having a conveyor belt 51, the latter being preferably of the suction type, for gripping the sheets in succession, in which the said sheet conveyor means 50 are driven by a servo motor M3, preferably of the speed and phase control type, such as a brushless motor with a servo control system, which is also connected to the synchronizing means 70 and which drives a roller shaft 52.

In the proximity of the upstream portion of the sheet conveyor means 50 there are positioned the sheet feeder means 60, which, from the upstream to the downstream end, comprise a first pair of transfer rollers 61 and 62 for extracting a continuous strip 3 from a reel which is not illustrated, a rotating cutter 63, for cutting the continuous strip 3 when so commanded, and a second pair of transfer rollers 64 and 65, for feeding the strip-3 and, after cutting, the sheets 2 towards and on to the suction belt 51 of the sheet conveyor means 50.

The two pairs of transfer rollers 61–62 and 64–65 are driven by a servo motor M4, preferably of the speed and phase control type, such as a brushless motor with a servo control system, which is also connected to the synchronizing means 70, and the rotating cutter 63 is driven by a servo control unit M5, also connected to the synchronizing means 70.

Optionally, depending on the type of packaging material used and/or the length of the sheet to be formed and/or the amplitude of the wave which is to be obtained, as explained more fully below, it is possible to provide guides 66 and 67, which are preferably extendable, for guiding the strip and sheet 3-2 during its travel towards the suction belt 51, and, again optionally, the said sheet feeder means 60 can also be made to oscillate angularly with respect to an axis 68 parallel to the plane of movement of the sheets formed by the suction belt 51, in order to be able to vary (see FIG. 2) the angle (3 of incidence between the sheet feed plane 2 of the sheet feeder means 60 and the sheet conveying plane defined by the active run of the suction belt 51 of the sheet conveyor 20 means 50 and, in this context, to fix, for example by means of a graduated bar 69 and clamps, the said sheet feeder means in an optimal angular position so that the extendable guides 66 and 67 can then be adjusted, and also to provide an outer casing 60*a* for the said sheet feeder means 60, in order to avoid contact between the material forming the packaging accumulated portion of material 2*b* and the operating elements 61–62–63–64–65 of the said sheet feeder means 60, in order to optimize the operation of the system according to the present invention, as will be explained more fully below.

Upstream of the said sheet feeder means 60 there are positioned means for controlling the unwinding of the reel of continuous packaging strip, which are not described or illustrated here since they lie outside the scope of the present invention.

Figure 8:
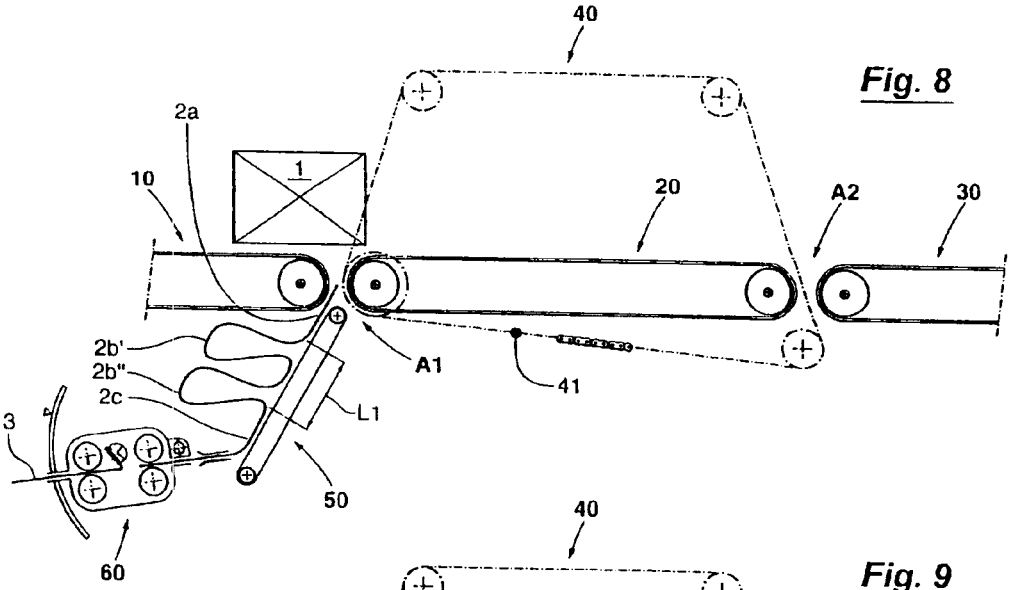
FIG. 8 illustrates a different form of the method according to the present invention.
Figure 9:
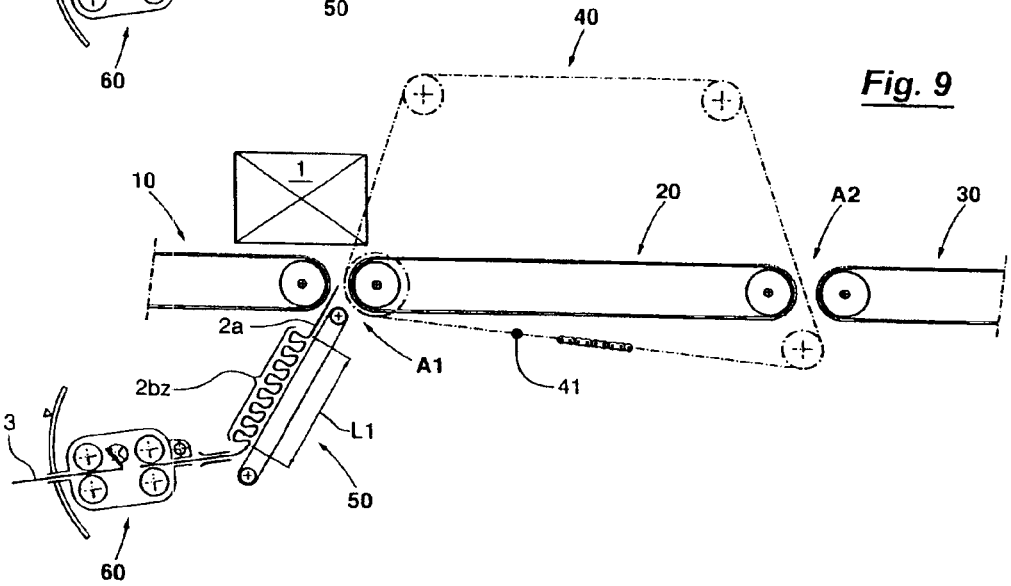
FIG. 9 illustrates a different form of the method according to the present invention.

In the first place, with reference to the description, the figures and the claims, it should be emphasized that, primarily but not essentially, one of the characteristics of the present invention consists in the fact that the sheet 2 of packaging material is moved by the sheet conveyor means 50 towards the sheet wrapping means 40 in a configuration which produces an accumulated portion 2*b* of material (in a loop as shown and not in a flat way as in the known art), in which the said accumulated portion 2*b* (see FIG. 2) makes it possible to obtain along a segment LI of the conveying run of the suction belt 51 a length of packaging material which is much greater than the said length LI. The accumulated portion 2*b* can be in a loop of the undulating type with a single peak (crest) as shown in the said FIG. 2, or of the undulating type with multiple peaks (crests) 2*b*'–2*b*", as shown in FIG. 8, or of the gathered undulating type 2*bz* as shown in FIG. 9, or of another type, without departure from the inventive concepts protected by the present invention.

The accumulated portion 2*b* (FIG. 2), or 2*b*'–2*b*" (FIG. 8), or 2*bz* (FIG. 9) of packaging material above and along the suction belt 51 can be formed by means of various embodiments of the invention.

In a first embodiment, in order to produce along the conveying run of the suction belt 51 a sheet 2 having an accumulated portion 2*b* which is undulating with a single peak (see FIG. 2), in other words a sheet 2 in the form of an "Ω" with horizontal (flat) projections 2*a* and 2*c* spread out and gripped by the said suction belt 51, during the phase of feeding the strip and sheet 3-2 on to and towards the suction belt 51, by means of the motors M3 and M4, a first phase is provided in which the feeding speed of the sheet feeder means 60 is equal to the transport speed of the sheet conveyor means 50, thus producing on the belt 51 a first portion 2a spread out on the said belt 51, and then a second phase, in which the said sheet conveyor means 50 are stopped temporarily while the sheet feeder means 60 are kept in motion, thus forming a second undulating accumulated portion 2*b* of material, and a third phase, in which the feeding speed of the sheet feeder means 60 is equal to the transport speed of the sheet conveyor means 50, thus forming on the belt 51 a third portion, 2*c*, spread out on the said belt 51.

In a second embodiment, in order to produce along the conveying run of the suction belt 51 a sheet 2 having an undulating accumulated portion 2*b*'–2*b*" with two or more peaks (crests) (see FIG. 8), in other words a sheet 2 arranged in the form of "ΩΩ", "106 ΩΩ", etc., by means of the motors M3 and M4, the aforesaid second and third phases are repeated one or more times.

In a third embodiment, in order to produce along the conveying run of the suction belt 51 a sheet 2 having an accumulated portion 2*b* which is undulating with a single peak (see FIG. 2), in other words a sheet 2 in the form of an "Ω" with horizontal (flat) projections 2*a* and 2*c* spread out and gripped by the said suction belt 51, during the phase of feeding the strip and sheet 3-2 on to and towards the suction belt 51, by means of the motors M3 and M4, a first phase is provided in which the feeding speed of the sheet feeder means 60 is equal to the transport speed of the sheet conveyor means 50, thus producing on the belt 51 a first portion 2*a* spread out on the said belt 51, and then a second phase, in which the sheet conveyor means 60 are driven with a feeding speed of the strip and sheet 3-2 greater than the pick-up speed of the belt 51 of the sheet conveyor means 50, thus forming a second undulating accumulated portion 2*b* of material with a single peak, and a third phase, in which the feeding speed of the sheet feeder means 60 is equal to the transport speed of the sheet conveyor means 50, thus forming on the belt 51 a third portion, 2*c*, spread out on the said belt 51.

In a fourth embodiment, in order to produce along the conveying run of the suction belt 51 a sheet 2 having an undulating accumulated portion 2*b*'–2*b*" with two or more peaks (see FIG. 8), in other words a sheet arranged in the form of "ΩΩ", "ΩΩΩ", etc., by means of the motors M3 and M4, the aforesaid second and third phases are repeated one or more times.

In a fifth embodiment, in order to produce along the conveying run of the suction belt 51 a sheet 2 having a gathered accumulated portion 2*bz* (see FIG. 9), during the phase of feeding the strip and sheet 3-2 on to and towards the suction belt 51, by means of the motors M3 and M4, a first phase is provided, in which the feeding speed of the sheet feeder means 60 is equal to the transport speed of the sheet conveyor means 50, thus producing on the belt 51 a first portion 2*a* which is spread out on the said belt 51, then a second phase in which the sheet conveyor means 60 are driven at a feeding speed of the strip and sheet 3-2 which is greater than the pick-up speed of the belt 51 of the sheet conveyor means 50, thus forming a second, gathered, accumulated portion of material 2*bz,* in which the shape of the gathering is subject to and determined by the chosen operating speed and/or the angle of incidence R between the sheet feed plane 2 and the sheet conveying plane and/or the thickness, weight, and bending resistance of the 30 packaging material used.

With reference to FIGS. 2 to 8, a description will now be given of an operating method for the packaging machine described above, in which the sheets 2 of packaging material are fed along the said sheet conveyor 50 in a configuration having an accumulated portion 2*b* of material with a single peak in the form of an "Ω", although, clearly, the said method is applicable in an identical way by using sheets having their accumulated portions configured according to one of the aforesaid variants, with two or more peaks 2*b*'–2*b*", in a gathered shape 2*bz*, or in another form, without departure from the inventive concepts indicated and protected herein.

With reference to the aforesaid figures, the objects 1 are transported in succession, singly and spaced apart, from the upstream to the downstream end, preferably with a continuous motion, being transported longitudinally along the three object conveyors 10, 20 and 30.

At a lower level, the sheets 2 of packaging material, in the aforesaid configuration in which an undulating accumulated portion 2*a* of material is provided, are progressively formed and transported by means of the suction belt 51 of the sheet conveyor means 50 towards the opening A1, and one or more orbiting bars 41 of the wrapping means 40 are made to move along their wrapping path.

Figure 2:
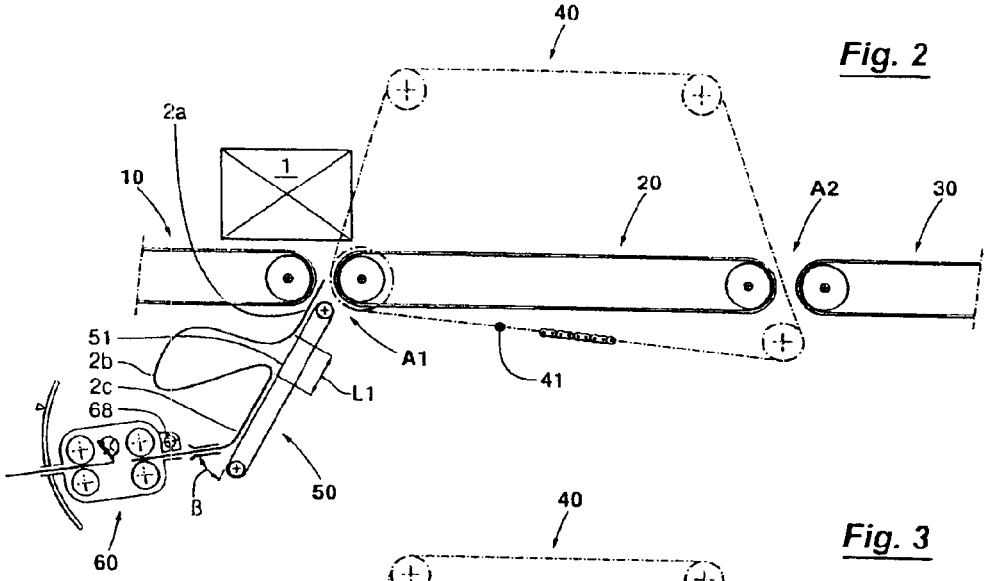
FIGS. 2, 3, 4, 5, 6 and 7 illustrate operating sequences according to the method and system according to the present invention.

With reference to FIG. 2, when an object 1, during its longitudinal advance, straddles the first object conveyor 10 5 and the second object conveyor 20, the sheet conveyor 50 transports downstream a sheet 2 having the undulating accumulated portion 2*b* of material, in such a way as to position the front portion 2*a* of the said sheet 2 at the entry end of the second object conveyor 20 in synchronization with the arrival of the object 1.

Figure 3:
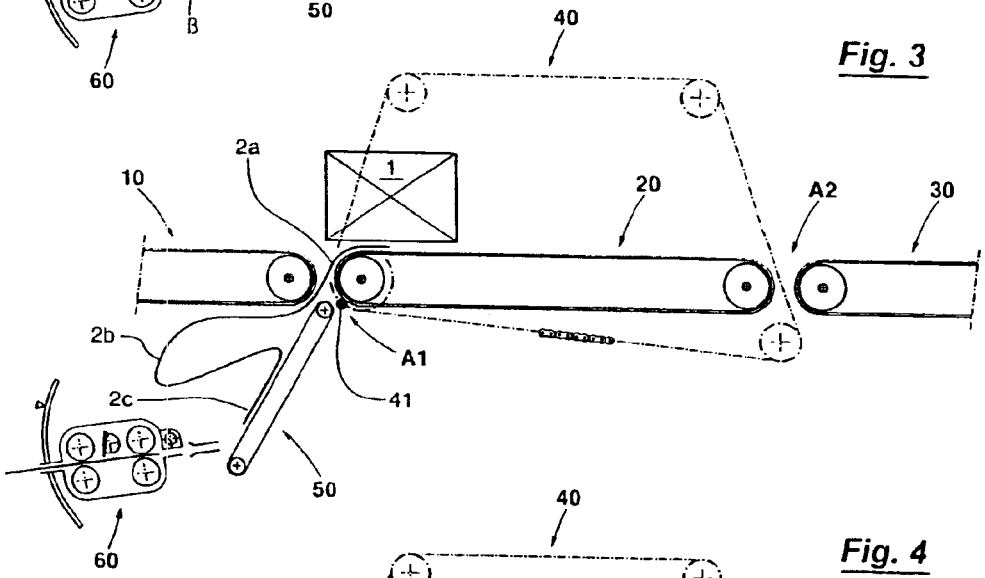

With reference to FIG. 3, the object conveyor means 20 and the sheet conveyor means 50 have been driven preferably at the same speed, and therefore the front portion 2*a* of the sheet 2 has been placed correctly between the base of the object 1 and the transport plane of the second object conveyor 20.

Figure 4:
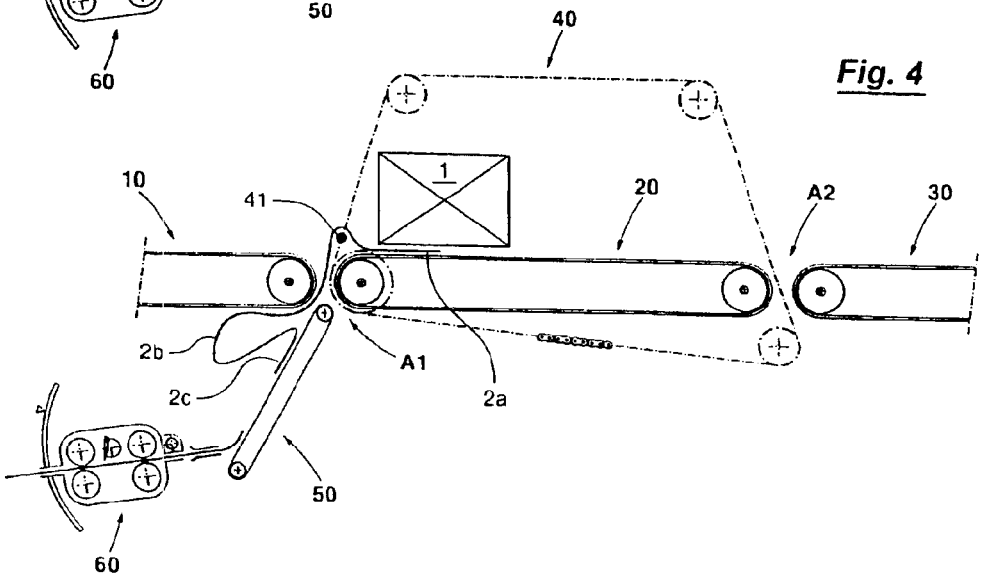
Figure 5:
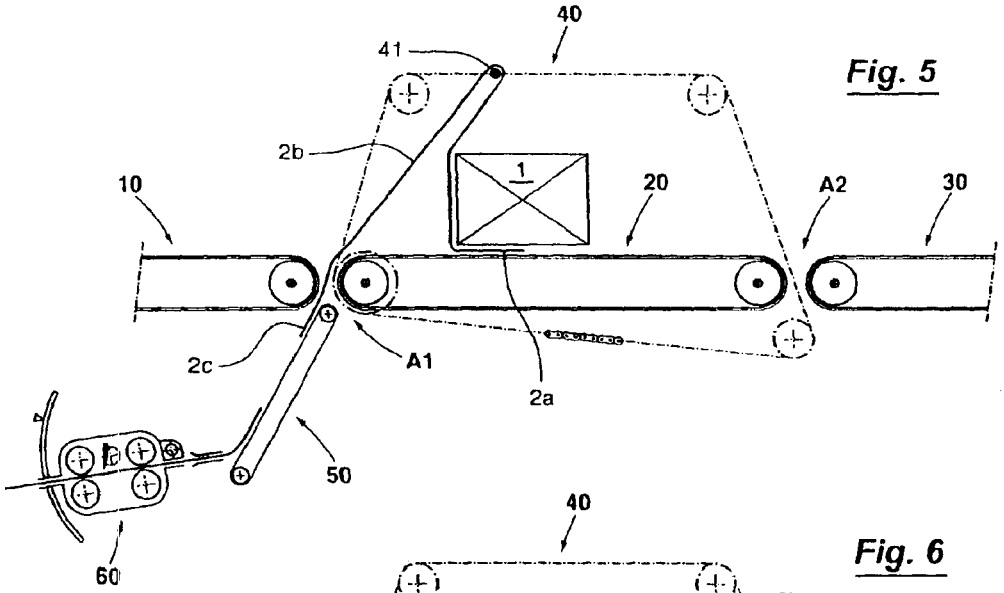

With reference to FIG. 4, when the rear end of the object 1 has passed beyond the said first opening A1 and the accumulated portion 2*b* of material has reached the proximity of the said first opening A1, the wrapping bar 41 encounters the accumulated portion 2*b* of material, and, during the next phase (see FIG. 5), in which the wrapping bar 41 draws the sheet 2 over the object 1 in a downstream direction, the said undulating accumulated portion of material 2*b* is used, thus overcoming the aforesaid drawbacks of the known art which required two sheet conveyors in series and in which the transport speed of the second sheet conveyor had to be increased during the said phase.

Preferably, but not exclusively, it is best to provide a phase relationship between the said sheet conveyor means 50 and the said sheet wrapping means 40 in which, essentially, when the initial part of the said accumulated portion of material 2*b* reaches the proximity of the said first opening A1, the wrapping bar 41 of the wrapping means 40 passes upwards through the said first opening A1, in order to initiate immediately the phase of transport of the sheet 2.

Figure 6:
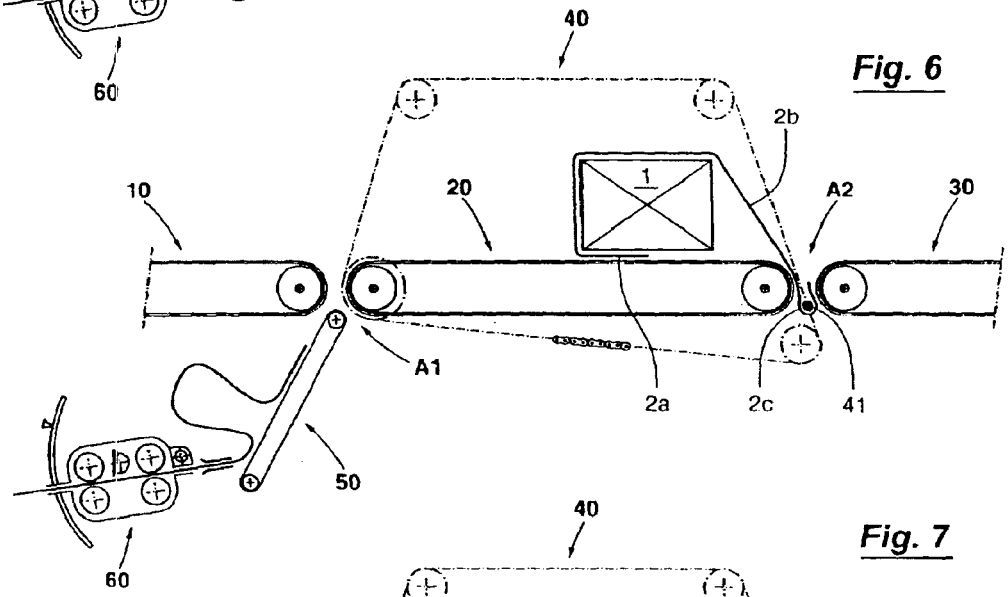
Figure 7:
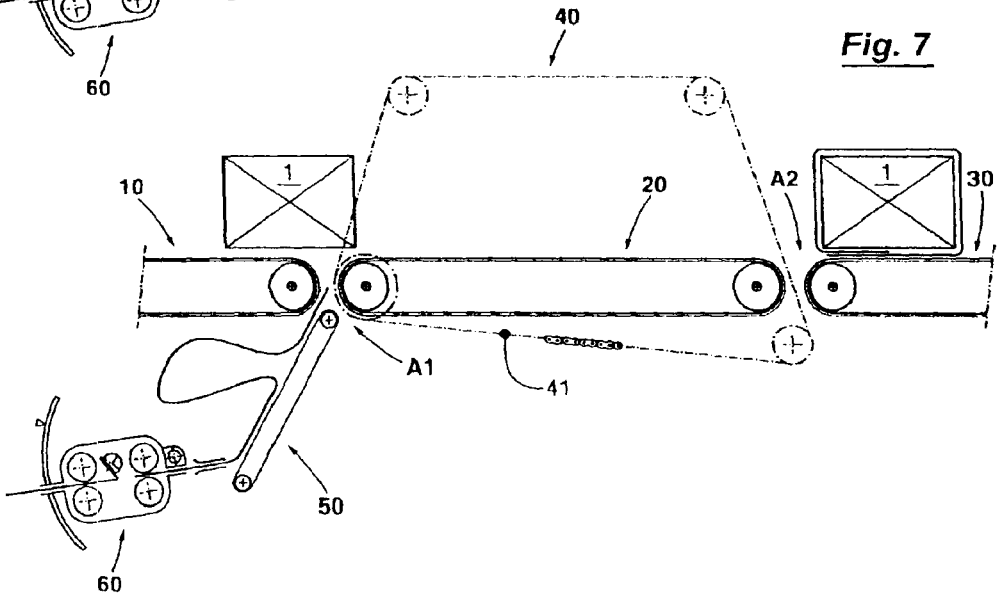

With reference to FIG. 6, the speed of advance of the wrapping bar 41 is such that it is brought beyond the object 1 and downwards to a position below the transport plane of the conveyors 20 and 30, being made to pass through the second opening A2, before the object 1 reaches the said second aperture A2, in order to position the terminal part of the sheet 2 so that it hangs between the said second conveyor 20 and the said third conveyor 30.

Finally (see FIG. 7), the object 1 is transported by the second conveyor 20 on to the third conveyor 30, the terminal part of the sheet 2 being positioned under the object I and under the initial part 2*a* of the said sheet 2.

With reference to the above description, in the case in which the said objects I comprise groups of bottles or the like, in order to optimize the packaging cycle while avoiding the tipping of the said bottles due to their acceleration and/or deceleration, it is preferable to provide a constant speed drive for the three object conveyor means 10–20–30, in order to transport the groups 1 with a continuous unidirectional motion from the upstream to the downstream end, and accordingly to provide a variable speed drive for the sheet wrapping means 40 and for the sheet conveyor means 50, in order to obtain the desired phase relationships for the implementation of the aforesaid phases of operation.

With reference to the above description, in order to optimize the unwinding of the reel of packaging material while avoiding the acceleration and/or deceleration of the reel and/or the use of "buffer" devices for the packaging material placed between the said reel and the sheet feeder means 60, it is preferable to provide a constant speed drive for the sheet feeder means 60 and therefore to drive the sheet conveyor means 50 with a variable motion, in order to obtain the desired phase relationships for the implementation of the aforesaid phases of operation.

The above description of the operating method and of the machine are provided solely by way of example and without restrictive intent, and it is therefore clearly possible to modify and/or vary these in ways suggested by practice and their use or application within the scope of the following claims, in which the latter form an integral part of the above description.

What is claimed is:

1. An operating method for a packaging machine of the "sleeve" type, which wraps sheets of packaging material around objects, in which the said machine comprises:

a first object conveyor for feeding the objects longitudinally in a spaced sequence;

a second object conveyor, located downstream of end at a short distance from said first object conveyor thus forming a first opening between said first and said second object conveyors for receiving objects arriving from said first object conveyor and for transporting said objects along a wrapping plane which has an entry end and an exit end;

a third object conveyor located downstream of and at a short distance from said second object conveyor and forming therewith a second opening between the second and said third object conveyors for receiving the objects arriving from said second object conveyor;

a sheet wrapper, located in proximity to said second object conveyor and comprising at least one suspended wrapping bar which is oriented transversely with respect to a direction of advance of the objects and adapted to move through said first and said second openings along an orbital path which circumscribes the top of the said second object conveyor, and can transport said sheets;

a sheet conveyor having a conveyor belt, positioned underneath and aligned with said first opening, for feeding the sheets into said first opening (A1); and a synchronizer for synchronizing said sheet wrapper with each other, said synchronization causing an accumulated portion to form on said conveyor belt, said accumulated portion of material being of the undulating type with at least two crests;

moving on said conveyor belt and toward said first opening at least a portion of accumulation of packaging material; and moving the wrapping bar upward through said first opening when said portion of accumulation of packaging material is disposed in proximity of said first opening.

2. The operating method defined in claim 1 wherein the sheet disposed on said conveyor belt has a configuration comprising a first portion in which the packaging material is spread out on said conveyor belt and wherein said first portion is positioned downstream with respect to said portion of accumulation.

3. The operating method defined in claim 2, further comprising the step of:

forming on said conveyor belt said portion of accumulation in which the packaging material is disposed accumulated on and along a segment of said conveyor belt.

4. The operating method defined in claim 3 wherein the sheet disposed on said conveyor belt has a configuration comprising a further third portion in which the packaging material, is spread out on said conveyor belt and wherein said third portion is positioned upstream with respect to said portion of accumulation.

5. The operating method defined in claim 4 wherein the said configuration of the sheet having an accumulated portion of material is of the undulating type with a single crest.

6. The operating method defined in claim 4 wherein the said configuration of the sheet having an accumulated portion of material is of the gathered type.

7. The operating method defined in claim 1 wherein a phase relationship is provided between the said sheet conveyor and said sheet wrapper in which, when the initial part of the said accumulated portion of material reaches the proximity of the said first opening, the wrapping bar passes through the said first aperture to initiate a phase of conveying the sheet.

8. The operating method defined in claim 1 wherein the first, second and third conveyors are driven at constant speed in order to transport the objects with a constant motion from the entry to the exit end, and wherein the sheet wrapper and/or the sheet conveyor are driven at variable speed in order to produce phase relationships for the execution of the wrapping operations.

9. The operating method defined in claim 1 in which the objects are advanced in individual succession from an upstream side toward downstream side and in which for each object to be packaged the following steps are provided;

moving on said conveyor belt (51) and toward said first opening a sheet having a configuration that comprises at least a portion of accumulation of packaging material in which the packing material is accumulated along a segment of said conveyor belt;

supplying a front portion of the of the sheet towards an entry end of the said second object conveyor in phase with the arrival of the object on the object second conveyor, the said front portion of the sheet being disposed between the object and a transport surface of the second object conveyor;

moving the wrapping bar upward through said first opening, when the rear end of the object has passed beyond the said first opening and when the portion of accumulation of packaging material is in proximity of said first opening;

moving the wrapping bar along the orbital path above the object and in the downstream direction drawing said accumulated portion supplied toward said first aperture by said conveyor belt;

moving the wrapping bar beyond the object and then downwards through said second opening before the object reaches the second aperture itself, dangling a terminal part of the piece of the sheet between the said second conveyor and the said third conveyor means; and moving the object from the second conveyor means to the third conveyor and placing the terminal part of the sheet beneath the object.

10. The operating method defined in claim 1 wherein said machine additionally comprises a sheet feeder, located upstream of said sheet conveyor, for feeding sheets of packaging material towards and onto the conveyor belt of the sheet conveyor, wherein the accumulated portion of material provided for the sheet is formed on the conveyor belt (51) by using for the said sheet feeder feeding speed for the sheets greater than a conveying speed of the conveyor belt of the sheet conveyor means.

11. The operating method defined in claim 10 wherein the configuration of the sheet having an accumulated portion of material is of the undulating type with a single crest and is produced by means of the following phases:

a first phase in which the speed of feeding the sheet imparted by the sheet feeder is equal to a transport speed of the belt imparted by the sheet conveyor means, thus producing on the conveyor belt a first portion which is spread out;

a second phase in which a transport motion of the conveyor belt of the sheet conveyor is temporarily stopped, while a motion for feeding the sheet of the sheet feeder is maintained. thus producing a second, undulating accumulated portion of material, and a third phase in which the speed of feeding the sheet imparted by the sheet feeder is equal to the transport speed of the belt imparted by the sheet conveyor means, thus producing on the conveyor belt a third portion which is spread out.

12. The operating method defined in claim 11 wherein the configuration of the sheet having an accumulated portion of material of the undulating type with at least two crests is produced by reflecting the second and third phase one or more times.

13. The operating method defined in claim 10 wherein the configuration of the sheet having an accumulated portion of material of the undulating type with at least one crest is produced by means of the following phases:

a first phase in which the speed of feeding the sheet imparted by the sheet feeder is equal to a transport speed of the belt imparted by the sheet conveyor, thus producing on the conveyor belt a first portion which is spread out;

a second phase in which the speed of feeding the sheet imparted by the sheet feeder is greater than the transport speed of the belt imparted by the sheet conveyor, thus producing on the conveyor belt a second, accumulated portion of material which is undulating with a crest, and a third phase in which the speed of feeding the sheet imparted by the sheet feeder is equal to the transport speed of the belt imparted by the sheet conveyor, thus producing on the conveyor belt a third portion which is spread out.

14. The operating method defined in claim 13 wherein the configuration of the sheet having an accumulated portion of material of the undulating type with two or more crests is produced by repeating the second and third phases.

15. The operating method defined in claim 10 wherein the configuration of the sheet having an accumulated portion of material of the gathered type is produced by means of the following phases:

a first phase in which the speed of feeding the sheet imparted by the sheet feeder is equal to the transport speed of the belt imparted by the sheet conveyor, thus producing on the conveyor belt a first portion which is spread out; and a second phase in which the speed of feeding the sheet imparted by the sheet feeder is greater than the transport speed of the belt imparted by the sheet conveyor, thus producing on the conveyor belt (51) a second, accumulated portion of material which is gathered.

16. The operating method defined in claim 10 wherein the said sheet feeder is provided with a cutter and the said sheet feeder initially feeds towards the said conveyor belt the front portion of a continuous strip after which the said continuous strip is cut by said cutter in order to produce the sheet.

17. The operating method defined in claim 10 wherein the sheet feeder is driven with a constant motion and the sheet conveyor is driven with a variable motion.

18. The operating method defined in claim 10 wherein an angle of incidence between a plane in which the sheets are fed and a plane in which the sheets are conveyed is varied in order to obtain the desired configuration of the accumulated portion of the sheet.

19. A packaging machine comprising:

a first object conveyor for feeding the objects longitudinally in a spaced sequence;

a second object conveyor, located downstream of end at a short distance from said first object conveyor thus forming a first opening between said first and said second object conveyors for receiving objects arriving from said first object conveyor and for transporting said objects along a wrapping plane, which has an entry end and an exit end;

a third object conveyor located downstream of and at a short distance from said second object conveyor and forming therewith a second opening between the second and said third object conveyors for receiving the objects arriving from said second object conveyor;

a sheet wrapper, located in proximity to said second object conveyor and comprising at least one suspended wrapping bar which is oriented transversely with respect to a direction of advance of the objects and adapted to move through said first and said second openings along en orbital path which circumscribes the top of the said second object conveyor, and can transport said sheets;

a sheet conveyor having a conveyor belt, positioned underneath and aligned with said first opening, for feeding the sheets into said first opening (A1); and a synchronizer for synchronizing said conveyor and said sheet wrapper with each other, said synchronization causing an accumulated portion to form on said conveyor belt, said accumulated portion of material being of the undulating type with at least two crests;

said first, second and third object conveyors being driven by a first servo motor connected to said synchronizing;

said sheet wrapper being driven by a second servo motor connected to the said synchronizer;

said sheet conveyor being driven by a third servo motor connected to said synchronizer and transporting towards the said first opening said sheet of wrapping material having an accumulated portion of material; and said synchronizer comprising a programmable control unit which controls the said first, second and third servo motor, in such a way that the said wrapping bar picks up the said accumulated portion of material in the proximity of the said first opening and then conveys the sheet around the object.

20. The packaging machine defined in claim 19 wherein said conveyor belt of the sheet conveyor is of the suction type.

21. The packaging machine defined in claim 20 wherein said machine additionally comprises a sheet feeder; located upstream of said sheet conveyor, for feeding sheet of packaging material towards and on the conveyor belt of the sheet conveyor, said sheet feeder being driven by a fourth servo motors connected to said synchronizer; said programmable control unit controlling the fourth servo motor; and in order to produce the accumulated portion of material, said programmable control unit controls the speed of the said third servo motor and of the said fourth servo motor in such a way that the transport speed of the conveyor belt of the sheet conveyor is lower than the sheet feeding speed of the sheet feeder.

22. The packaging machine according to claim 19 wherein said sheet feeder additionally comprises a cutter for cutting a continuous strip of packaging material in order to produce the sheets, said cutter being driven by a servo control unit and controlled by the synchronizer.

23. The packaging machine according to claim 19 wherein said sheet feeder is oscillatable angularly about an axis lying parallel to a plane of transport of the sheets formed by the conveyor belt, to make it possible to adjust an angle of incidence between a plane in which the sheets are fed and a plane in which the sheets are conveyed.

24. The packaging machine according to claim 19 wherein an outer casing is provided to enclose operating elements said sheet feeder in order to avoid contact between the material forming the accumulated portion and the said operating elements.

* * * * *